US008609167B2

(12) United States Patent
Ernst et al.

(10) Patent No.: US 8,609,167 B2
(45) Date of Patent: Dec. 17, 2013

(54) METHOD OF OPERATING COMMERCIAL COOKING EQUIPMENT, IN PARTICULAR, ALSO COOKING EQUIPMENT FOR CARRYING OUT THE METHOD

(75) Inventors: Markus Ernst, Murnau (DE); Lutz Riefenstein, Wielheim I (DE)

(73) Assignee: Convotherm Elektrogerate GmbH, Eglfing (DE)

( * ) Notice: Subject to any disclaimer, the term of this patent is extended or adjusted under 35 U.S.C. 154(b) by 915 days.

(21) Appl. No.: 12/086,568

(22) PCT Filed: Dec. 13, 2006

(86) PCT No.: PCT/EP2006/012021

§ 371 (c)(1),
(2), (4) Date: May 18, 2010

(87) PCT Pub. No.: WO2007/073872

PCT Pub. Date: Jul. 5, 2007

(65) Prior Publication Data

US 2010/0227029 A1 Sep. 9, 2010

(30) Foreign Application Priority Data

Dec. 16, 2005 (EP) ..... 05027619

(51) Int. Cl.
*A01K 43/00* (2006.01)

(52) U.S. Cl.
USPC ..... 426/231; 426/520; 426/407; 426/510; 426/511; 426/523; 99/325; 219/401

(58) Field of Classification Search
USPC ..... 426/231, 233, 520, 407, 510, 511, 523; 219/401; 99/325
See application file for complete search history.

(56) References Cited

U.S. PATENT DOCUMENTS 4,204,204 A 5/1980 Pitstick ..... 345/173
5,097,759 A 3/1992 Vilgrain et al. ..... 99/483

(Continued)

FOREIGN PATENT DOCUMENTS

DE 4324015 12/1994 ..... A47J 27/14
DE 20320945 U 6/2005 ..... A47J 39/00

(Continued)

OTHER PUBLICATIONS

International Search Report and Written Opinion dated Aug. 6, 2007 based on PCT application No. PCT/EP2006/012021.

*Primary Examiner* — Drew Becker
*Assistant Examiner* — Preston Smith
(74) *Attorney, Agent, or Firm* — Ohlandt, Greeley, Ruggiero & Perle, LLP

(57) ABSTRACT

The disclosure is a method of operating a commercial cooking equipment, in particular a hot-air steamer or fan oven, comprising the following method steps:

a) selecting a product requiring cooking having an assigned cooking program or selecting at least one cooking parameter having assigned selectable products;
b) loading the cooking equipment with a selected product;
c) starting the associated cooking program;
d) displaying the name of the program and at least the remaining cooking time;
e) associating in automated manner further products or cooking programs that fit in with the cooking program of the first selected product in dependence on cooking parameters, in particular, the cooking temperature and/or the cooking humidity and/or the fan speed;
f) displaying the selectable products or selectable cooking programs;
g) selecting, on demand, a further product which matches the first product in accordance with the associating process;
h) loading the cooking equipment with the further product;
i) starting the assigned cooking program;
j) displaying the name of the program and at least the remaining cooking time for the further product;
k) if necessary, repeating the steps g) to j); and
l) removing the product from the cooking equipment at the expiry of the respective cooking time.

11 Claims, 5 Drawing Sheets

(56) References Cited

U.S. PATENT DOCUMENTS

| | | | | |
|---|---|---|---|---|
| 6,864,472 | B2 * | 3/2005 | Kang | 219/757 |
| 2003/0047553 | A1 | 3/2003 | Patti et al. | 219/400 |
| 2003/0150853 | A1 * | 8/2003 | Kang | 219/720 |

FOREIGN PATENT DOCUMENTS

| | | | | |
|---|---|---|---|---|
| EP | 1275333 | | 1/2003 | A47J 27/04 |
| EP | 1501336 | * | 1/2005 | |
| GB | 2380923 | | 4/2003 | A21B 1/40 |

* cited by examiner

METHOD OF OPERATING COMMERCIAL COOKING EQUIPMENT, IN PARTICULAR, ALSO COOKING EQUIPMENT FOR CARRYING OUT THE METHOD

BACKGROUND

1. Field of the Disclosure

The disclosure relates to a method of operating commercial cooking equipment, in particular, a hot-air steamer or a fan oven.

2. Discussion of the Background Art

Cooking equipment for regenerating prepared foodstuffs is known from DE 203 20 945 U1, this being equipped with a control element comprising an input unit for manually initiating clocks for each regenerating level containing prepared foodstuffs and a display unit for indicating a time interval characteristic of an initiated clock for the purpose, inter alia, of achieving better utilization of the cooking equipment.

Despite these auxiliary features, known cooking equipments retain the disadvantage that the service personnel select the correct clock for the selected insertion level and must enter the correct cooking time manually, this being something which can lead to problems particularly in Fast-Food restaurants since restaurants of this type usually employ unskilled personnel for running the restaurant. However, such personnel are often not really in a position to select the settings for the equipment, such as the setting of the cooking time in the case described above, in dependence on the cooking programs and the products of different kinds needing cooking due to their lack of previous knowledge and the extremely short training periods.

Due to this state of affairs, the cooking equipment known from the specification of the utility model specified above is not particularly suitable for Fast-Food or Quick-Service restaurants.

Other known cooking equipment, wherein, once the pre-prepared foodstuffs have been inserted, the equipment can only be restocked after the expiry of the previously set cooking program, are unsuitable for use in Fast-Food restaurants because the equipment is rarely fully loaded in such restaurants due to the fact that smaller amounts of a product have to be produced within a short time period and in addition, the capacity of the temporary storage facilities is only very limited in restaurants of this type.

Consequently, the object of the present disclosure is to provide a method of operating a commercial cooking equipment, in particular, a hot-air steamer or a fan oven in which even small quantities of different products can be produced quickly whilst effectively utilising the available capacity of the cooking equipment.

SUMMARY OF THE DISCLOSURE

The present disclosure is based on the fundamental idea of bringing together groups of products having the same or almost the same cooking parameters, particularly such as the cooking time, so that, after beginning the process of cooking a product, one is able to additionally insert further products having the same cooking parameter or parameters, particularly the same or almost the same cooking temperature, in with the product that is already present in the cooking equipment in a quick and safe manner, the basis for this being the facility of utilising the capacity of the cooking equipment in an optimum manner even when only relatively small quantities of the individual products have to be prepared, the quantities themselves being such that they could not fully use the capacity of the cooking equipment.

Further details, advantages and features of the present disclosure are apparent from the following description of exemplary embodiments taken in conjunction with the accompanying drawing. Therein:

DETAILED DESCRIPTION OF THE PREFERRED EMBODIMENT

Figure 1:
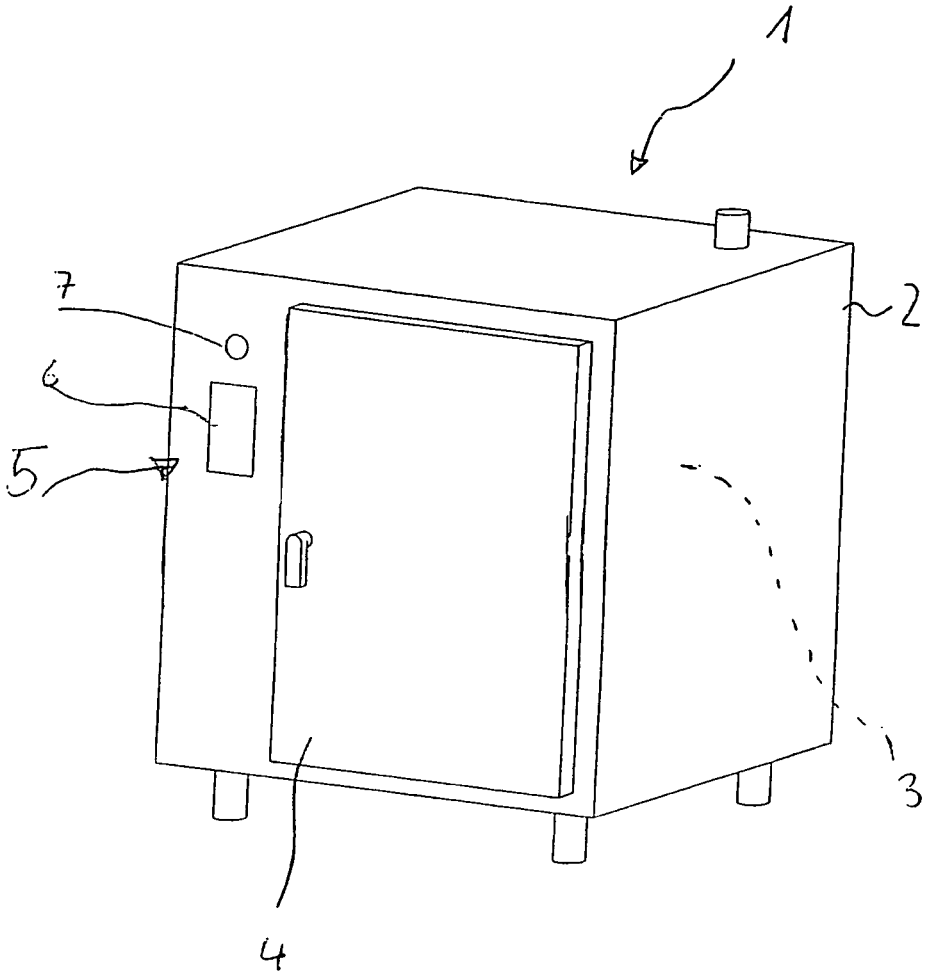
FIG. 1 shows a schematically simplified illustration of a cooking equipment in accordance with the disclosure, FIGS. 2-4 schematically simplified illustrations of a display and operating field of the cooking equipment in accordance with FIG. 1, and FIGS. 5-7 details from a display and operating field for explaining individual process steps of the method in accordance with the disclosure.

A commercial cooking equipment 1 in accordance with the disclosure, particularly in the form of a hot-air steamer or a fan oven, is depicted in FIG. 1 in the form of a schematic, somewhat simplified perspective illustration. The cooking equipment 1 comprises a housing 2 having a cooking area 3 arranged therein. The cooking area 3 can be closed and opened by means of a cooker door 4.

Products can be cooked in the cooking area 3 by circulating air or superheated steam with the help of suitable heating and fan devices which can be of the same type as those used in conventional cooking equipment so that these components, which are also utilised in the cooking equipment 1 in accordance with the disclosure, do not need to be described in detail here.

On the front side of the housing 2, there is arranged a display and operating field 5 which comprises a touch panel 6 and an on/off switch 7. The cooking equipment 1 in accordance with the disclosure is deliberately not equipped with further operating components such as an outlet equipment, since, in accordance with the principles of the method in accordance with the disclosure, the service personnel are to be prevented from manipulating the cooking equipment 1 (with the exception of operating steps made possible by the display and operating field 5).

Figure 2:
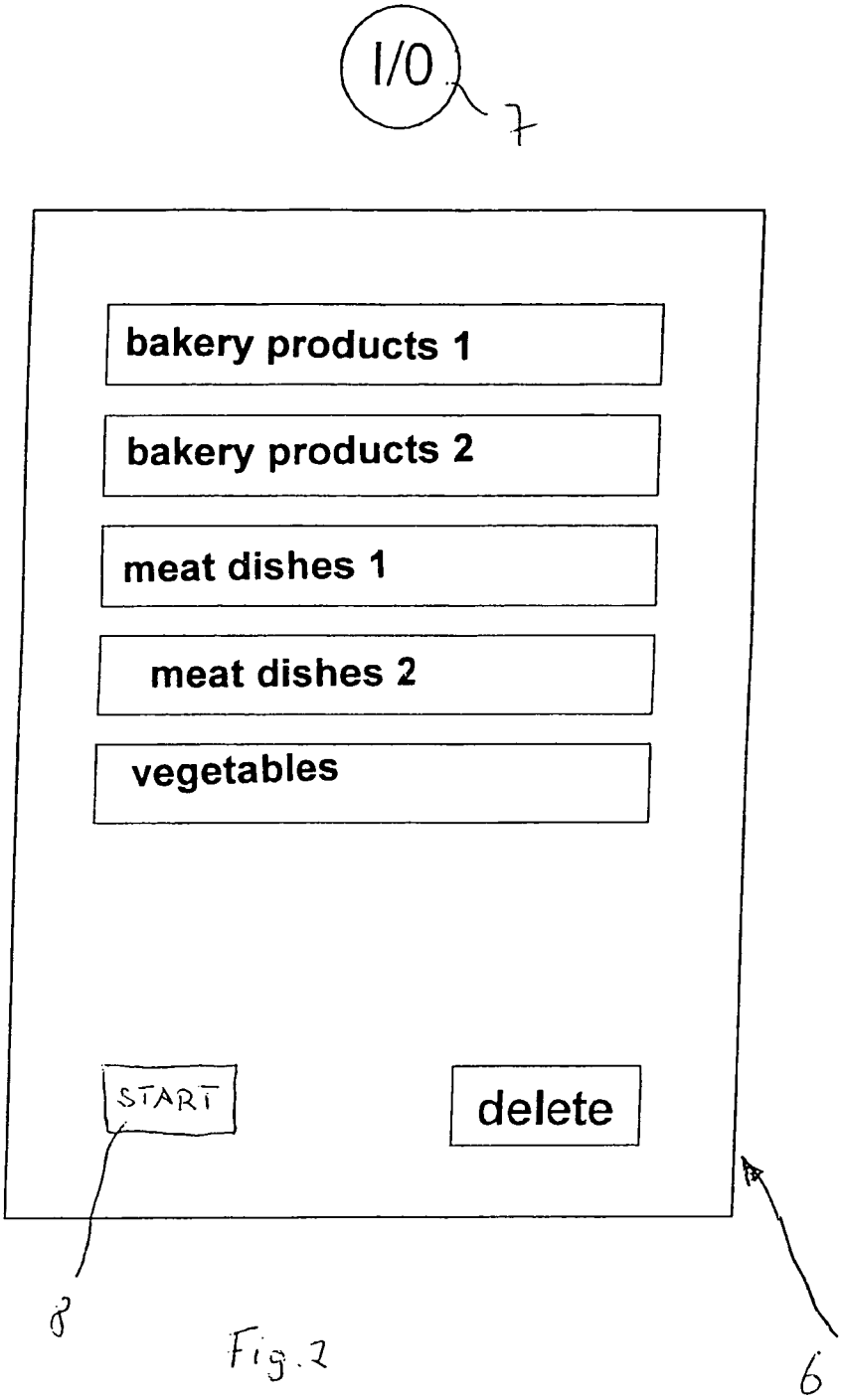
Figure 3:
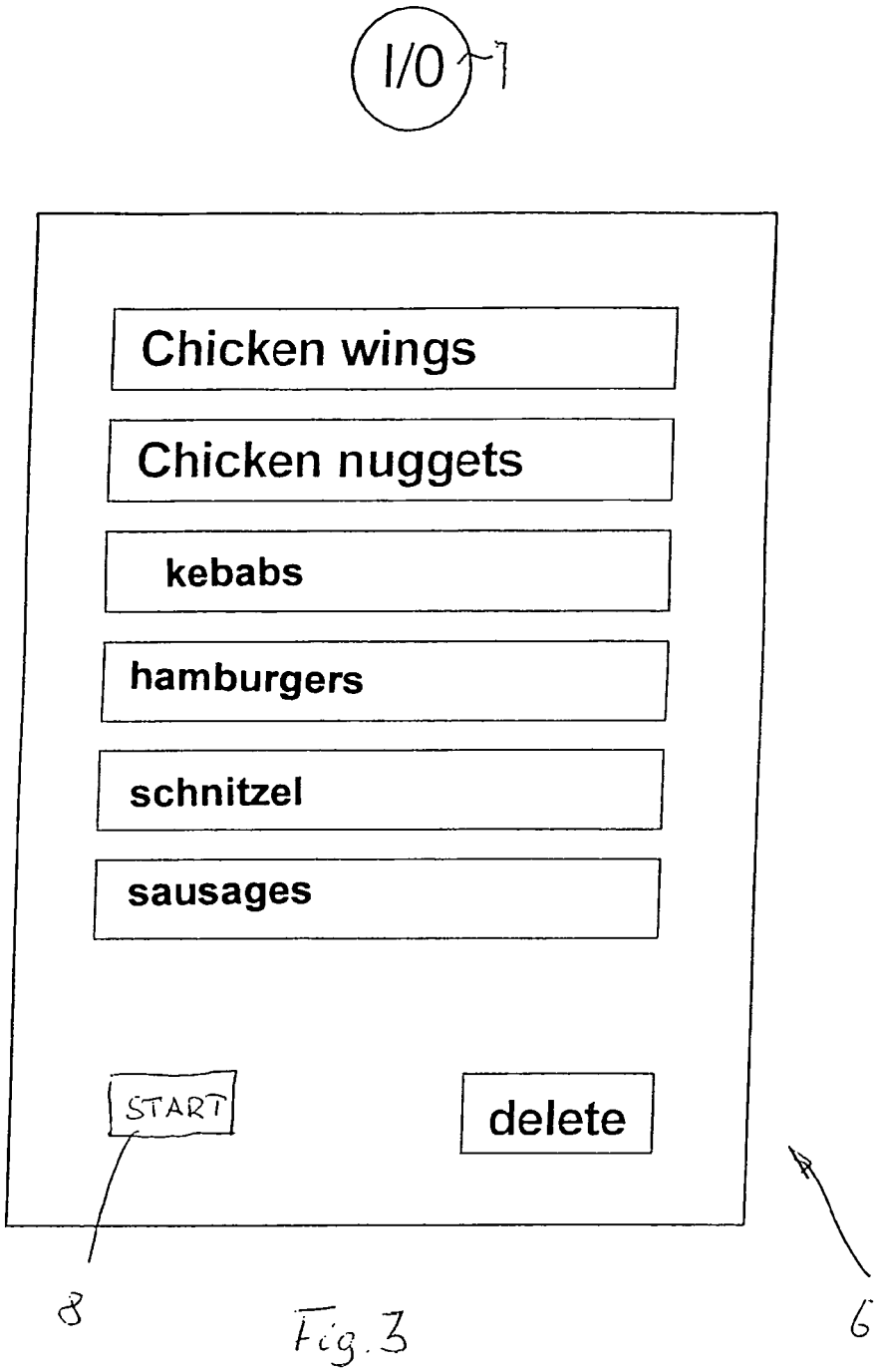
Figure 4:
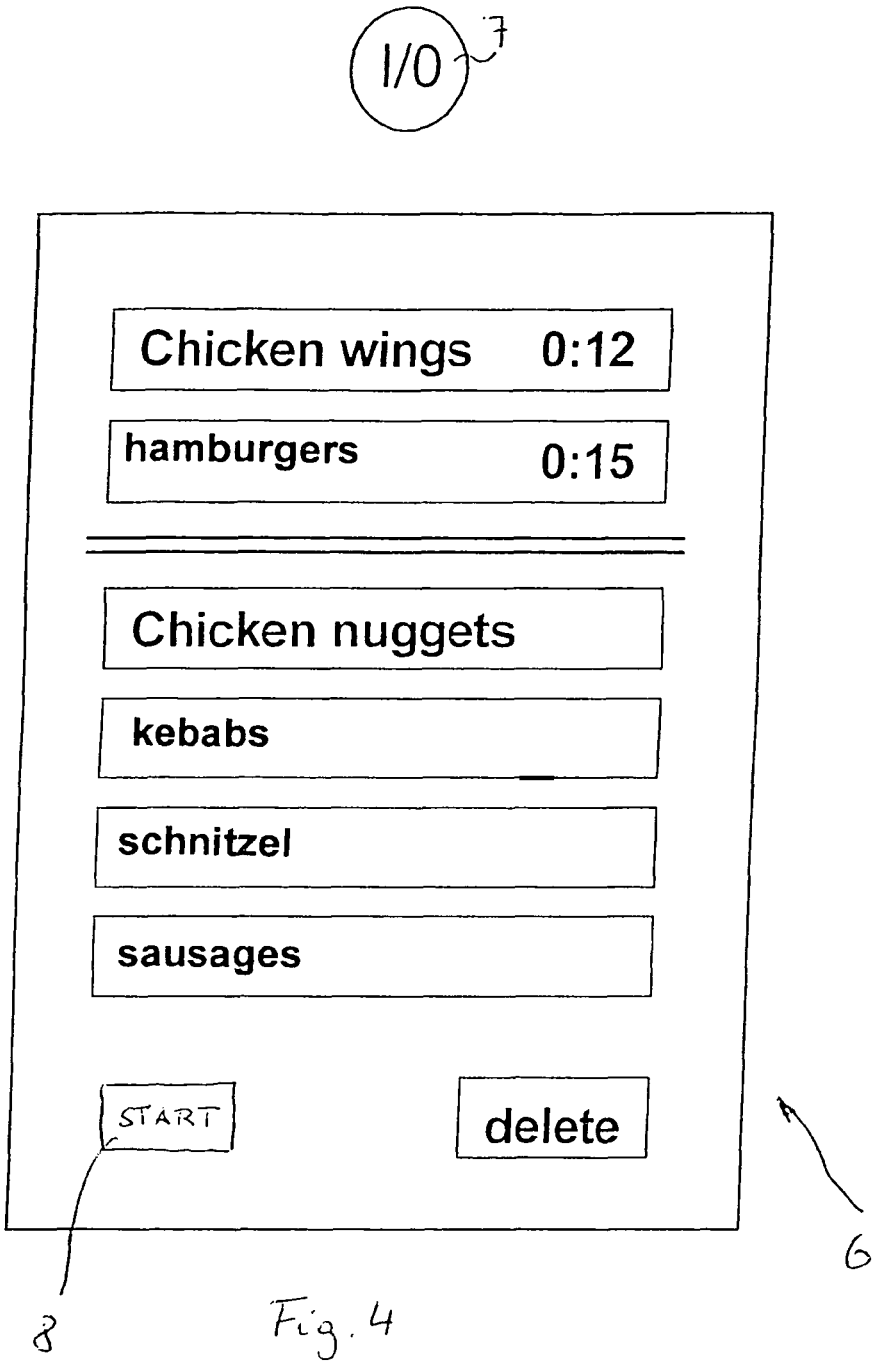

The touch panel 6 and the on/off switch 7 are illustrated in FIGS. 2 to 4 on an enlarged scale.

Hereby, FIG. 2 makes it clear that the display unit 7 can indicate products arranged into categories which, in the case of the example here, are called "bakery products 1, bakery products 2, meat dishes 1, meat dishes 2, and vegetables".

These generic terms are representative of the individual products that are assigned to these particular terms for programming purposes and which automatically rank amongst the products being selected if one of the generic terms for the wares is selected in accordance with the examples described above.

FIG. 3 depicts the same touch panel 6 but in this case, the individual items "chicken wings, chicken nuggets, kebabs, hamburgers, schnitzel, sausages" are shown, this representing an alternative to the use of generic terms for the goods.

FIG. 4 shows a situation in which the touch panel 6 is displaying the items "chicken wings 0:12" and "hamburgers 0:15" that appear in the highest two display fields above a double line which represents a compartment, this meaning that these two products are already present in the cooking equipment 1, whereby the data "0:12" and "0:15" indicate the respectively remaining cooking times and the products are arranged in ascending order from top to bottom in terms of the remaining cooking times.

The remaining items "chicken nuggets, kebabs, schnitzel, sausages" belong to a corresponding selection of products although they have not as yet been inserted into the cooking equipment 1 in the situation represented here, but rather, they form a reserve selection so to say for subsequent transfer into the cooking equipment 1. In order to signal this optically, the two highest items "chicken wings, hamburgers" are separated by the double line from the remaining four products.

Finally, the so-called "delete-key" that is also illustrated in the Figures serves to clear the current display in the event of an incorrect entry or an aborting action.

Figure 5:
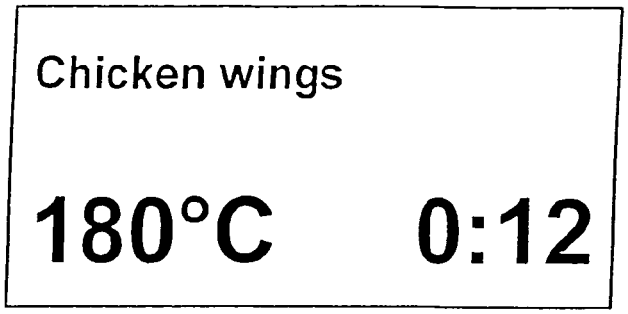

In one conceivable embodiment of the method in accordance with the disclosure, the commercial cooking equipment 1 can be operated as follows:

Firstly for example, based upon the anticipated number of orders, one must select the products that are to be cooked in correspondence with these orders and which have a cooking program (e.g. chicken wings in 12 minutes, see FIG. 5) assigned thereto.

The equipment is loaded with the selected product and the cooking program is started, this, for example, taking place exclusively by simply pressing on the program name or a start button 8. Once it has started, the program name (e.g. chicken wings in 12 minutes, see FIG. 5) is displayed. An association of further products suitable for the cooking program of the first product as a function of the cooking temperature (and optionally too, the cooking humidity and/or the rotary speed of the fan etc.) is simultaneously effected automatically (thus, for example, as suitable for chicken wings:hamburgers; see FIG. 3). The automated association process leads to a display of the selection of products on the equipment, this being capable of being effected selectively on either a permanent basis or on request, for example, by pressing on a product selection button. From the overall number of cooking programs available in the equipment, only those are displayed which fit the current cooking program (see e.g. FIG. 3).

Figure 7:
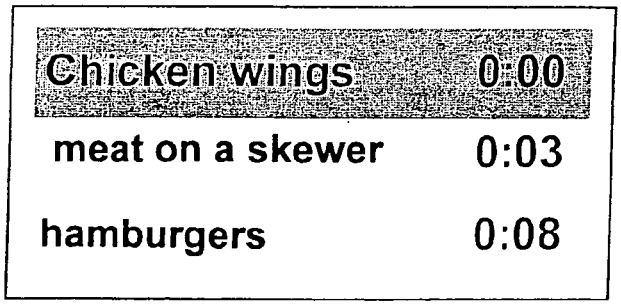

If, after the cooking equipment has been loaded with the first product, there is a further order (e.g. hamburgers), then the previously displayed selection of products matching the first product (chicken wings) is checked by the serving personnel. If the latter establishes that the further order (hamburgers) is a product on the displayed selection of products, then the correspondingly assigned cooking program (hamburgers) can be activated, the cooking equipment loaded with the second product (hamburgers) and the cooking program restarted, this also being capable of being displayed. The first cooking program (chicken wings) is not affected by the starting of the second product, but rather, a second cooking time or a second timer is started automatically, this monitoring the second cooking time (here, for the hamburgers) and displaying the end of the cooking period, for example, optically and/or acoustically (see e.g. FIG. 7 for chicken wings).

Figure 6:
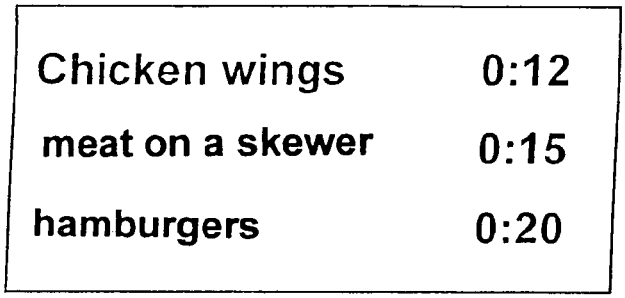

FIG. 6 shows a state in which three products are being prepared in the cooking area, although these are not yet finished as is indicated by the remaining cooking times.

As an alternative to the previously described procedure, it is possible to display a selection of the available cooking parameters (e.g. cooking temperature, cooking humidity, fan speed) instead of displaying a selection of products that can be cooked, the pertinent selection of a product then taking place on the basis of the displayed parameters.

As already mentioned, it is possible to provide the display of the selectable products permanently or on request.

Hereby, it is possible to carry out the product pre-selection such that it is not in the form of individual products, but rather, in the form of generic terms for certain products (e.g. bakery products 1, bakery products 2, meat dishes 1, meat dishes 2, vegetables; see FIG. 2; instead of the listing of all conceivable products).

Furthermore, it is possible for the display of the individual products to be produced automatically by the cooking equipment, in each case sorted according to cooking times so that the product having the shortest remaining cooking time is indicated at the highest position for example.

In order to enable the method in accordance with the disclosure to be accomplished in still simpler a manner, it is possible for the display of the products to be effected by means of symbols and/or photos of the respective product rather than or as well as the written description so that, for example, operation of the equipment can take place independently of the language abilities of the service personnel.

In order to exclude still further the possibility of loading the equipment incorrectly, it is possible for the products to be provided with a coding (e.g. a bar code) and for this coding to be checked by an appropriate reading device connected to the cooking equipment before loading anything into the equipment. If the coding falls within the range of selectable products, then the selected type of product is taken to be correct and can be placed in the cooking equipment by the service personnel.

If the coding is wrong, a warning can be produced in order to signal that the product selected by the server does not fall within the range of selectable products.

Furthermore, in the course of reading the coding and establishing the correctness of the selected product in this type of embodiment of the method in accordance with the disclosure, it is possible for the respectively assigned cooking program to be started at the same time without this having to be repeated again by the server e.g. by pressing a start button on the cooking equipment.

Apart from the attachment of bar codes to the product and bar code reading devices to the cooking equipment or any other general usage of codings and reading devices, it is also possible to accomplish the monitoring process by means of a camera.

For the purposes of implementing the method in accordance with the disclosure, it is possible for the recipes or individual cooking programs to be composed and programmed centrally on a master equipment in a test kitchen and for the respective locally arranged cooking equipment, i.e. the equipment actually being used in the restaurants, to be loaded only with the centrally compiled cooking programs so that any manipulation whatsoever of such equipment, which can also be referred to as "Outlet equipment", can be prevented, this thereby further increasing the protection from errors.

Hereby, it is naturally also possible for the composition of the product groups to be established in the master equipment by a competent person such as a chef for example. Apart from precise cooking parameters, it is naturally also possible to make provision for tolerances such as for example, a certain temperature tolerance of e.g. 5 to 10° which is then compensated for locally in the Outlet equipment by an automated increase or reduction of the cooking time, this thereby further increasing the flexibility of the method in accordance with the disclosure. In this case, it is then possible to query closely related cooking programs which are not identical to the selected one in the Outlet equipment.

The invention claimed is:

1. A method of operating a hot-air steamer or fan oven commercial cooking device, the method comprising the steps of:

a) selecting a product requiring cooking having an associated cooking program having at least one cooking parameter;

b) loading the cooking device with the selected product;

c) starting the associated cooking program for the selected product;

d) displaying an identification of the selected product and at least the remaining cooking time for its associated cooking program;

e) automatically associating products that may be cooked with the cooking program of the selected product to provide associated products;

f) displaying an identification of the associated product;

g) selecting a displayed associated product;

h) loading the cooking equipment with the associated product;

i) starting the cooking program for the associated product;

j) displaying the name and at least the remaining cooking time for the associated product;

k) optionally, repeating the steps g) to j) to start a cooking program for one or more additional associated products; and l) removing the selected product, the associated product and the one or more additional associated products from the cooking device at the end of their respective cooking times.

2. The method according to claim 1, wherein the display of products is effected permanently.

3. The method according to claim 1, wherein the display of products is effected on demand.

4. The method according to claim 1, wherein the display is arranged according to cooking time.

5. The method according to claim 1, wherein the display of products is effected by means of symbols for the products or photographs of the products.

6. The method according to claim 1, wherein the at least one cooking parameter is selected from the group consisting of cooking temperature, cooking time, fan speed and combinations of the foregoing.

7. The method according to claim 1, further comprising the step of confirming the identity of the product before the product is loaded into the cooking device.

8. The method according to claim 7, wherein the step of confirming is performed by detecting a product coding.

9. The method according to claim 7, wherein the step of confirming is performed by a camera monitoring system.

10. A method of operating a hot-air steamer or fan oven commercial cooking device, the method comprising the steps of:

a) selecting a cooking parameter having associated products that can be cooked according a cooking program having the selected cooking parameter;

b) selecting an associated product;

c) loading the cooking device with the selected product;

d) starting the cooking program for the selected product;

e) displaying an identification of the selected product and at least the remaining cooking time for its cooking program;

f) automatically associating products that may be cooked with the cooking program of the selected product to provide associated products;

g) displaying an identification of the associated products;

h) selecting a displayed associated product;

i) loading the cooking equipment with the associated product;

j) starting the cooking program for the associated product;

k) displaying the name and at least the remaining cooking time for the associated product;

l) optionally, repeating the steps h) to k) to start a cooking program for one or more additional associated products; and m) removing the selected product, the associated product and the one or more additional associated products from the cooking device at the end of their respective cooking times.

11. The method according to claim 10, wherein the cooking parameter is selected from the group consisting of cooking temperature, cooking time, fan speed and combinations of the foregoing.

* * * * *